US005116687A

United States Patent [19]

Asano et al.

[11] Patent Number: 5,116,687

[45] Date of Patent: May 26, 1992

[54] DECORATION FOR USE ON PACKAGES

[76] Inventors: Eiji Asano, 5-28, Nijigahama, Hiratsuka-shi, Kanagawa-ken; Yoshiko Iwaki, 2-8-17-302, Minami Kugahara, Oota-Ku, Tokyo, both of Japan

[21] Appl. No.: 527,411

[22] Filed: May 23, 1990

[30] Foreign Application Priority Data

May 24, 1989 [JP] Japan ..... 1-59148[U]

[51] Int. Cl.[5] ..... D04D 7/10

[52] U.S. Cl. ..... 428/542.8; 28/147; 223/46; 428/5

[58] Field of Search ..... 428/4, 415, 542.8; 223/46; 28/147

[56] References Cited

U.S. PATENT DOCUMENTS 4,515,837 5/1985 Cheng ..... 428/4
4,656,064 4/1987 Cheng ..... 428/4
4,900,632 2/1990 McGrath ..... 428/5 X

FOREIGN PATENT DOCUMENTS 64-4867 2/1989 Japan ..... 428/4

*Primary Examiner*—Henry F. Epstein
*Attorney, Agent, or Firm*—Armstrong, Nikaido, Marmelstein, Kubocik, & Murray

[57] ABSTRACT

An improvement in a decoration consisted of a belt shaped strip with plural segments longitudinally interconnected both edges of which segments are rounded out in substantially in symmetry and a looped elastic string folded and passed through plural holes provided on suitable positions of the belt shaped strip, the improvement comprising a decorative configuration provided on one end segment alone and consisted of at least two decorative pieces, said decorative configuration being formed only on one side of the segment with respect to the longitudinal axis of the belt-shaped strip.

7 Claims, 6 Drawing Sheets

DECORATION FOR USE ON PACKAGES

BACKGROUND OF THE INVENTION

1. Field of the Invention

The present invention relates to an improved decoration for use on packages.

2. Prior Art

Heretofore, there have been proposed such decorations for use on packages, for example as disclosed in Japanese Utility Model publication No. 64-4867, decorations are disclosed which comprise a single belt shaped strip provided with plural holes thereon and a looped elastic string folded and passed through the holes and are capable of forming an imitation flower, bowknot, rosette or the like decorative configuration, with the belt shaped strip squeezed by simply pulling the elastic string.

However, these decorations for packages involve such drawbacks, that, when the decorative configuration of the imitation flower or the like is formed, both ends of the belt shaped strip are positioned on both outsides of the belt shaped strip, with intermediate segments thereof gathered by the string. Thus, there can be produced an unattractive appearance in the decorative configuration of the imitation flower or the like. The more petals the imitation flower or the like has, the more unstability and unhandiness involved there.

The present invention is aimed at overcoming these drawbacks involved in the prior art decorations for use on packages.

SUMMARY OF THE INVENTION

For the purpose of achieving the above object, the improved decoration for use on packages according to the present invention comprises, a belt shaped strip with plural segments longitudinally interconnected both edges segments rounded out in substantially in symmetry and a looped elastic string folded and passed through plural holes provided on suitable positions of the belt shaped strip. A decorative configuration provided on one end segment alone and consisted of at least two decorative pieces, the decorative configuration being formed only on one side of the segment with respect to the longitudinal axis of the belt shaped strip.

The end decorative configuration is formed on one side with respect of the longitudinal axis of the belt shaped strip and is formed with the decorative pieces radially diverged and is positioned substantially perpendicular or parallel to the longitudinal axis of the belt shaped strip. A small hole is bored on a joint portion of the decorative pieces of the end segment for passing therethrough a looped elastic string.

The belt shaped strip may be formed with two or more segments interconnected that are rounded out, like a bulged. When such a strip composed of three or more segments is to be formed, it is preferred to employ segments that successively become larger or smaller from one end to the other so that there may be formed in combination a decorative configuration of imitation flower having many petals. With small holes bored at each side on the center portion of the segments of the belt shaped strip, there can be provided decorative pattern having more varied configuration.

When forming the belt shaped strip with many segments and varying the manner of interconnection, there can be provided decorations for use on packages which are varied and of good appearance. For example, the belt shaped strip may be composed of two pairs of segments, each pair having two segments, of the same size. the respective sizes of the both pairs of segments being such that one pair of segments, having the end decorative pieces provided thereon has larger size than such of the other pair and those pairs of segments are arranged perpendicular to each other, bent at a joint portion of the both pairs.

The belt shaped strip may also be composed of ten segments all of the same size and divided into three pairs respectively, having four, four and two segments, the three pairs being arranged substantially to form a triangular shape, bent at joint portions thereof, with the decorative pieces provided on a free end of one pair with two segments being arranged to extend respectively along the axial directions of such one pair.

The belt shaped strip may likewise be composed of twelve segments all of the same size and divided into three pairs, respectively, having four, four and four segments, such pairs being arranged, respectively, to intersect at an angle of 120 degrees bent at the joint portions thereof.

The looped elastic string is folded and passed through the holes provided on the belt shaped strip and then unremovably held at one end, lest the one end should be slipped out of the end hole where it is unremovably held. The means for unremovably holding the one end may be a knot formed by fastening the folded elastic string together as illustrated in the Japanese Utility Model Publication No. 64-4867. However, it is also convenient that a button-like or disk-like stopper, as shown in FIG. 1, is fixed on one end of the looped elastic string, with the stopper per se serving as a decorative configuration.

The manner of passing the looped elastic string through the holes of the belt shaped strip may be any one that is capable of serving to form a desired decorative configuration thereby.

Materials to be used for the belt shaped strip may be any kind of sheet, as heretofore in use, made of a paper, metallic film, plastic film, woven fabric, unwoven fabric or other flexible sheet.

As described above, the decoration for use on packages according to the present invention comprises end decorative pieces arranged only on one side, so that such end decorative pieces extend from one side alone when formed into a decorative configuration to produce a good appearance and an advantageous handiness.

Further, by varying the manner of interconnection of the segments of the belt shaped strip, there can be provided various types of decorative configurations.

DETAILED DESCRIPTION OF THE PREFERRED EMBODIMENTS

The present invention is described in more detail with reference to the accompanying drawings illustrating several embodiments thereof. First referring to FIG. 1 which shows a first embodiment of the present invention, a belt shaped strip 1 is composed of two segments 1*a*, 1*b* longitudinally interconnected, each being in the form of a bulge rounded out on both edges in symmetry. There are formed two decorative pieces 2*a*, 2*b* on one end of the belt shaped strip 1. These decorative pieces 2*a*, 2*b* are arranged substantially in V-shaped form while perpendicularly intersecting as a whole with the longitudinal axis of the belt shaped strip 1 with their joint portion located at one end of the strip 1. On a center portion of the belt shaped strip 1 where the end decorative pieces 2*a*, 2*b* are formed, there is bored a small hole 3*a* for passing a looped elastic string 4 therethrough.

The belt shaped strip 1 is constricted in V-shaped form at the constricting portion of the segments 1*a*, 1*b*, and there is provided another small hole 3*b* for passing the looped elastic string 4 therethrough at such center portion of the belt shaped strip 1 as corresponding to the constricted connecting portion. In addition, at the outer end of the segment 1*b*, the segment without the end decorative pieces 2*a*, 2*b*, there is further bored a small hole 3*c* for passing the looped elastic string 4 therethrough.

The front end on the side of the small hole 3*c* of the looped elastic string 4 is provided with a button-like stopper 5.

The looped elastic string 4 may be passed through the holes 3*a*, 3*b* and 3*c* in the opposite direction to the illustrated so that the stopper 5 may be positioned at the side of the small hole 3*a*.

Figure 1:
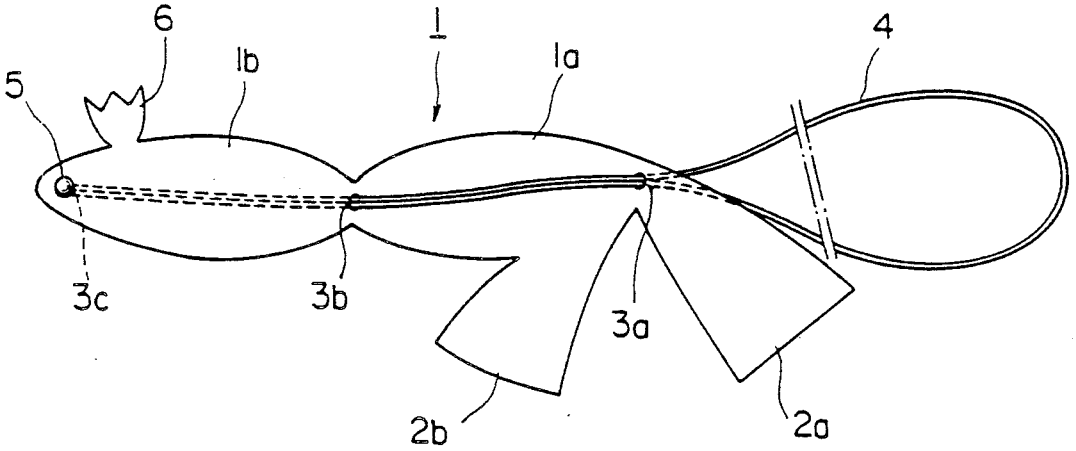
FIG. 1 is a developed plan view of a decoration for use on package according to one embodiment of the present invention.

On the upper edge in FIG. 1 of the segment 1*b* is provided in place a bulge-like decorative piece 6 as an accent for the decoration. Such accent may be suitably selected from various forms, for example, those of a star and animal besides the illustrated and it may be omitted.

Figure 2:
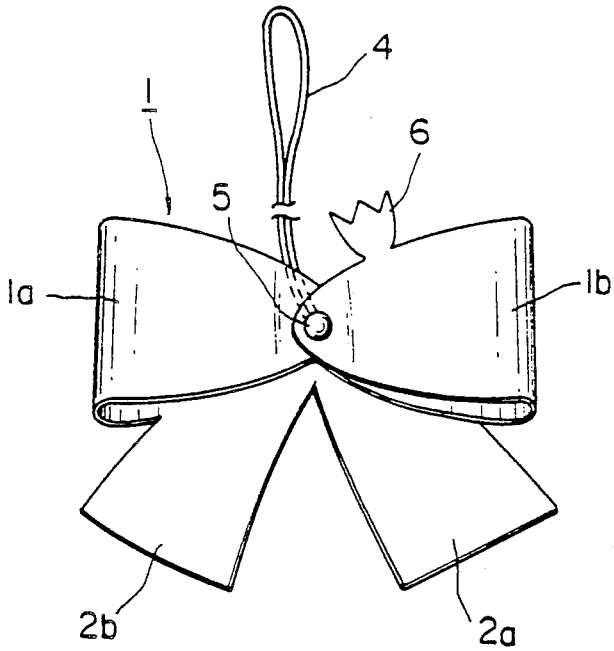
FIG. 2 is a plan view of the decoration of FIG. 1 as shown in completed form by gathering the segments thereof.

The decoration for use on packages which is illustrated in FIG. 1 as the first embodiment of the present invention can be completed to a decorative configuration as shown in FIG. 2 by squeezing or gathering with the looped elastic string 4. When completed, the decorative pieces 2*a*, 2*b* are naturally positioned on one side of the belt shaped strip thus folded or gathered and therefore the completed decoration as a whole provides a good appearance, stability and handiness no matter which side of the completed decoration, viz., the side with the decorative pieces 2*a*, 2*b* or the other side, is displayed obversely.

Figure 3:
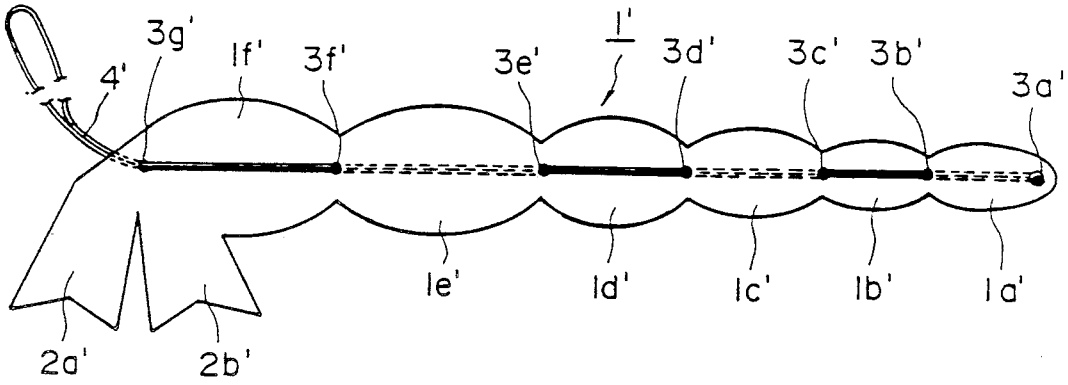
FIG. 3 is a developed plan view of a decoration for use on package according to another embodiment of the present invention.
Figure 4:
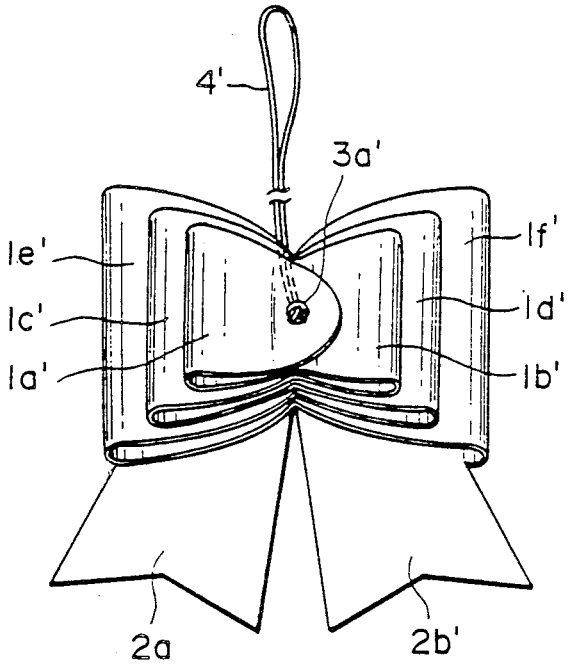
FIG. 4 is a plan view of the decoration of FIG. 3 as shown in completed form by gathering the segments thereof.

In FIG. 3, another embodiment of the present invention is illustrated. In this embodiment, the belt shaped strip 1' is composed of six segments 1*a*' 1*b*' 1*c*' 1*d*' 1*e*' and 1*f*' longitudinally interconnected. These segments are successively formed to become larger from the smallest 1*a*' to the largest 1*f*'. End decorative pieces 2*a*', 2*b*' are formed on the end of the largest segment 1*f*' alike those in FIG. 1. There are bored small holes 3*a*' . . . 3*g*' for passing a looped elastic string 4' therethrough on respective portions corresponding to the connecting portions of the segments. The completed decoration for use on packages in this embodiment as shown in FIG. 4 provides such a decorative configuration of an imitation flower having many petals, with the end decorative pieces 2*a*', 2*b*' protruding from only one side, that produce a good appearance and handiness.

Figure 5:
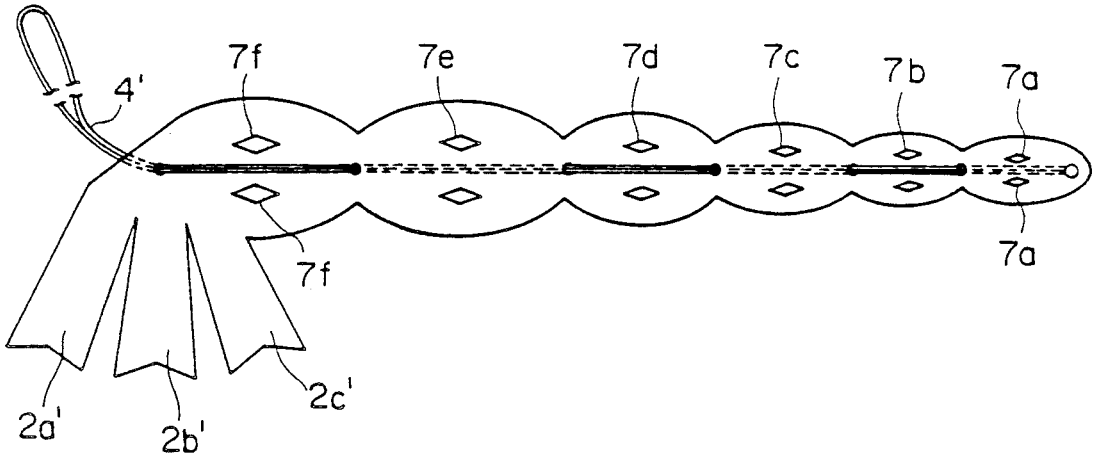
FIG. 5 is a developed plan view of a decoration for use on package according to a further embodiment of the present invention.
Figure 6:
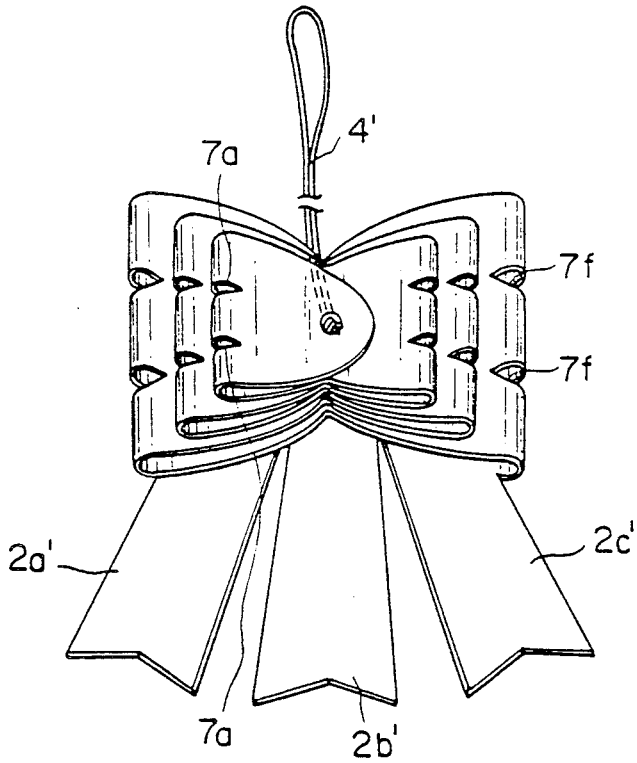
FIG. 6 is a plan view of the decoration of FIG. 5 as shown in completed form by gathering the segments thereof.

FIG. 5 shows a further embodiment of the present invention. In this embodiment, the segments 1*a*' . . . 1*f*' shown in FIG. 3 have pairs of diamond-shaped holes 7*a*, 7*a* . . . 7*f*, 7*f* respectively bored at upper and lower parts on the central portion of the segments along the longitudinal axis of the belt shaped strip and three end decorative pieces 2*a*', 2*b*' and 2*c*' formed on the largest segment. The belt shaped strip thus formed provides, when completed, such a decorative configuration as shown in FIG. 6 that not only has petals having two cuts on the front end thereof but also end decorative pieces 2*a*', 2*b*' and 2*c*'. Thus, decoration can provide a gorgeous impression as a whole.

Figure 7:
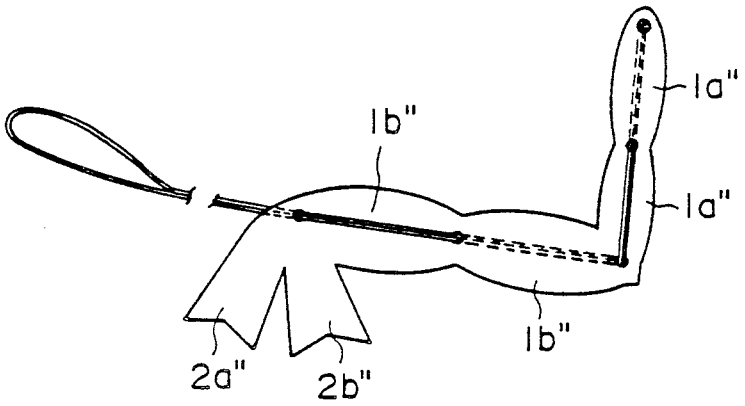
FIG. 7 is a developed plan view of a decoration for use on package according to a still further embodiment of the present invention.

In FIG. 7, a still further embodiment of the present invention is illustrated. In this embodiment, the belt shaped strip is composed of two pairs of segments, one with end two segments 1*a*'', and the other with two segments 1*b*'', respectively of the same size. The one pair with end decorative pieces 2*a*'' and 2*b*''' formed thereon is larger than the other pair and both pairs are arranged to perpendicularly intersect with each other end to end.

Figure 8:
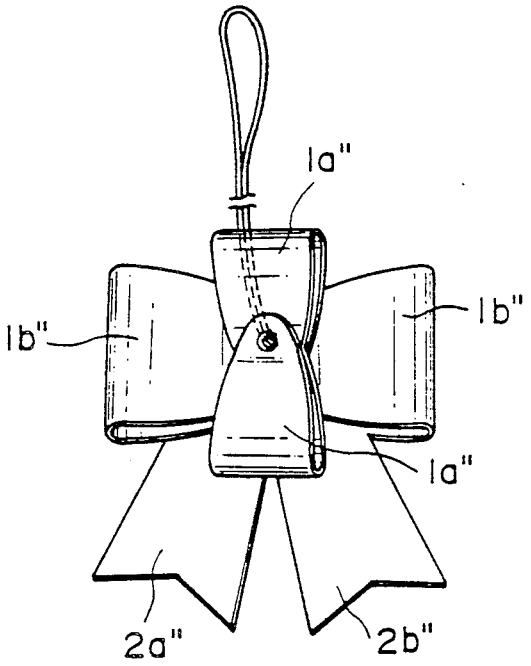
FIG. 8 is a plan view of the decoration of FIG. 7 as shown in completed form by gathering the segments thereof.

The decoration thus formed provides, when completed, a decorative configuration of an imitation flower as shown in FIG. 8 with the petals crossed per se different from those of the other embodiments.

Figure 9:
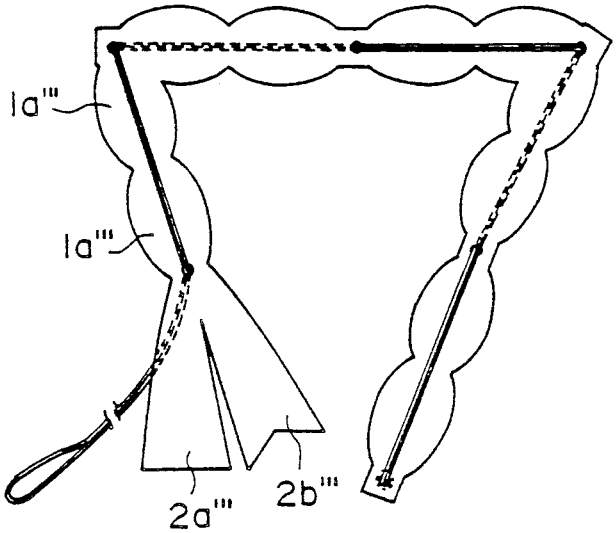
FIG. 9 is a developed plan view of a decoration for use on package according to a further embodiment of the present invention.
Figure 10:
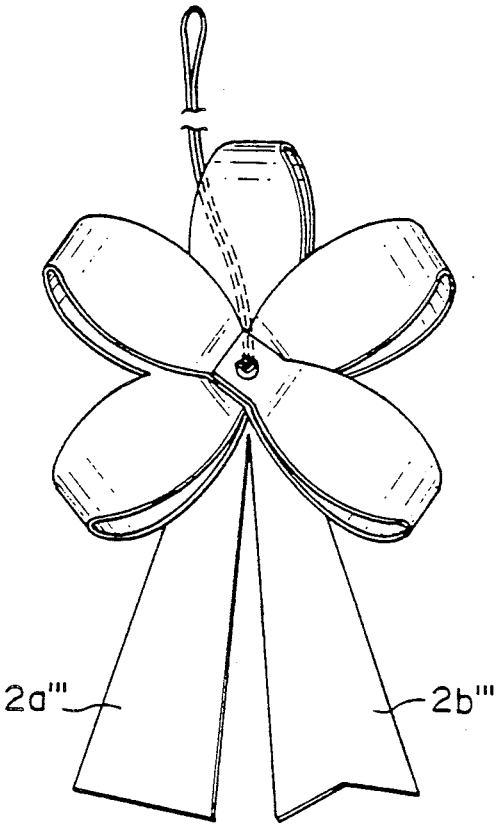
FIG. 10 is a plan view of the decoration of FIG. 9 as shown in completed form by gathering the segments thereof.

An embodiment illustrated in FIGS. 9 and 10 is composed of ten segments all of the same size which are divided into three pairs of four, four and two segments that are arranged to substantially constitute a triangular form with each pair interconnected end to end, and such end decorative pieces 2*a*''', 2*b*''' are formed on the free end of the one pair having the segments 1','', 1''' that extend in the direction of the longitudinal axis thereof. The decoration of this embodiment provides when completed such a decorative configuration of an imitation flower with five petals shown in FIG. 10.

Figure 11:
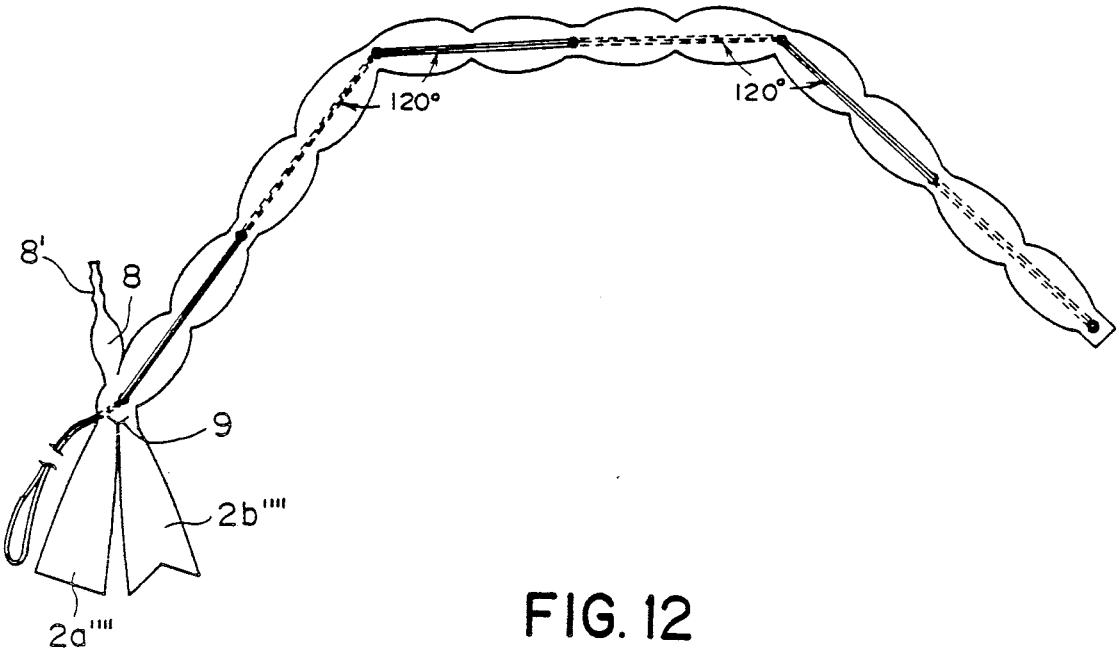
FIG. 11 is a developed plan view of a decoration for use on package according to a still further embodiment of the present invention.
Figure 12:
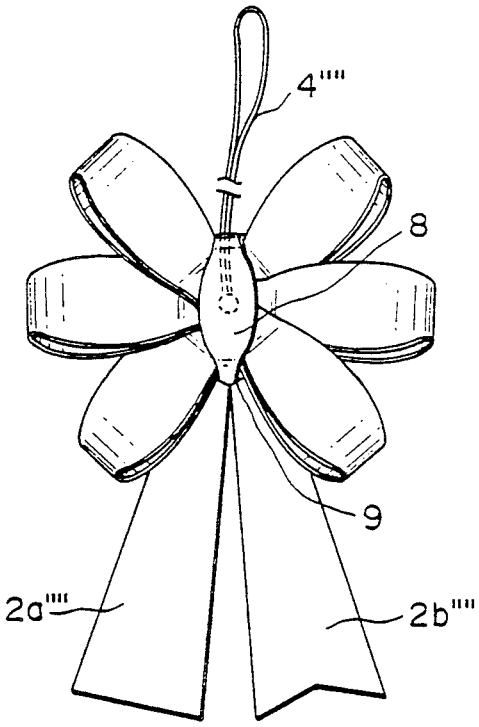
FIG. 12 is a plan view of the decoration of FIG. 11 as shown in completed form by gathering the segments thereof.

A further embodiment of the present invention as shown in FIGS. 11 and 12 is composed of twelve segments all of the same size which are divided into such three pairs all of four segments that are arranged to intersect in an angle of about 120 degree with each other end to end and when completed it provides a flower-like decorative configuration with six petals, as shown in FIG. 12. In this embodiment, near by a joint portion of the end decorative pieces 2*a*''', 2*b*''' to the belt shaped strip is provided such a tongue 8 in the form of a tadpole that extends in the direction opposite to said decorative pieces and has a meandering tail 8', and in the other hand, a V-shaped slit 9 is provided on the connecting portion of said decorative pieces. This tongue 8 serves to cover one end of the looped elastic string 4'''' passed through the end small hole when the decoration is completed, with the meanderings tail portion 8' inserted into the V-shaped slit 9. Thus, unlike that shown in FIG. 9, the front end of the looped elastic string 4'''' which is protruded from the small hole is not exposed outside and there can be kept a good appearance of the decorative configuration.

Manner of completion and use of the decoration for use on packages according to the present invention only requires, like with the conventional decoration of the same type, such a single operation that squeeze the belt shaped strip by gathering the segments thereof using the looped elastic string which is thereafter hung on the package to be decorated therewith.

The means to be provided on the looped elastic string for the prevention of the slipping out thereof may be selectively provided on one end with the decorative pieces formed thereon of the belt shaped strip or on the other end without such pieces, depending on, when the decoration is completed, which side thereof is exposed outside, one or the other with o without the decorative pieces.

What is claimed is:

1. A decoration consisting of a belt shaped strip with plural segments longitudinally interconnected, both edges of said segments being rounded out in substantial symmetry and a looped elastic string folded and passed through plural holes provided on suitable positions of the belt shaped strip, and having a decorative configuration provided on one end segment alone and consisting of at least two decorative pieces, said decorative configuration being formed only on one side of said one end segment with respect to the longitudinal axis of said belt shaped strip, said belt shaped strip being composed of at least three segments interconnected and successively becoming larger from one end to the other.

2. A decoration according to claim 1, wherein a pair of small holes are bored at upper and lower sides on a center portion of each segment of said belt shaped strip.

3. A decoration according to claim 1, wherein said belt shaped strip is composed of two pairs of segments, each pair having two segments, respectively, of the same size, respective sizes of the both pairs of segments being such that the one pair of segments having the end decorative pieces provided thereon have a larger size than those of the other pair and said pairs of segments are arranged perpendicular to each other and bent at a joint portion of said both pairs.

4. A decoration according to claim 1, wherein said belt shaped strip is composed of ten segments all of the same size and divided into three pairs respectively having four, four and two segments, said three pairs being arranged substantially to form a triangular shape bent at joint portions thereof, with the decorative pieces so provided on a free end of one pair with said two segments as to extend respectively along an axial direction of said pairs.

5. A decoration according to claim 1, wherein said belt shaped strip is composed of twelve segments all of the same size and divided into three pairs respectively having four, four and four segments, said pairs being arranged to intersect at an angle of 120 degrees bent at the joint portions thereof.

6. A decoration according to claims 1 or 2, wherein a button-like stopper is fixed to one end of said looped elastic string.

7. A decoration according to claim 1, wherein said belt shaped strip is composed of at least three segments interconnected and successively becoming smaller from one end to the other.

* * * * *